United States Patent [19]

Link

[11] 3,962,667

[45] June 8, 1976

[54] COMBINATION FUSE AND BUSHING

[75] Inventor: Edwin A. Link, Waukesha, Wis.

[73] Assignee: RTE Corporation, Waukesha, Wis.

[22] Filed: July 26, 1972

[21] Appl. No.: 275,178

[52] U.S. Cl. ..... 337/202; 174/142

[51] Int. Cl.[2] ..... H01H 85/02

[58] Field of Search ..... 337/202, 204, 158, 159, 337/273, 276; 174/142, 31 R, 152 R

[56] References Cited

UNITED STATES PATENTS

| | | | |
|---|---|---|---|
| 2,408,990 | 10/1946 | Mitchell | 174/142;31 R |
| 2,732,419 | 1/1956 | Wilson | 174/142 |
| 2,790,842 | 4/1957 | Nicholas | 174/152 R X |
| 2,835,725 | 5/1958 | Nicholas | 174/142 |
| 3,244,838 | 4/1966 | Astleford | 337/224 |
| 3,544,707 | 12/1970 | Gamble | 174/142 |
| 3,622,688 | 11/1971 | Link et al. | 174/152 R X |
| 3,633,141 | 1/1972 | Ristuccia | 337/202 |
| 3,648,211 | 3/1972 | McKeithan | 337/159 |
| 3,684,995 | 8/1972 | Horton | 337/224 |
| 3,806,625 | 3/1973 | Long | 174/142 |

*Primary Examiner*—R. N. Envall, Jr.
*Assistant Examiner*—F. E. Bell
*Attorney, Agent, or Firm*—Ronald E. Barry

[57] ABSTRACT

A fused high voltage electrical bushing adapted to be mounted at the entrance in a casing to an electrical apparatus to provide a connection between a high voltage cable and the electrical apparatus, the bushing including a housing formed of a dielectric material and having an axially extending passage, an electrical terminal sealed to each end of said passage, a fusible element within said passage, interconnecting the terminals, and a granular dielectric material completely filling the passage; a layer of electrically conductive material is provided on the inner surface of said passage and extends through the entrance in the casing to the electrical apparatus, the inner layer of material being spaced from and electrically connected to the element, and a layer of electrically conductive material on the outer surface of said housing for forming a stress cone at the entrance of the casing to said apparatus, the stress cone being grounded through said casing, the inner and outer layers cooperating to reduce voltage stress at the point of entrance through the casing.

3 Claims, 2 Drawing Figures

COMBINATION FUSE AND BUSHING

BACKGROUND OF THE INVENTION

Generally in high voltage apparatus housed in a casing, a bushing is used to provide an electrical connection through an opening or entrance in the casing between the apparatus and the high voltage cable. Fuses which are normally required for such apparatus are separately housed and separately connected to the electrical apparatus. In many instances these fuses are mounted in separate housings provided in separate openings in the casing. When installed within the casing, the casing must be opened in order to replace the fuse.

SUMMARY OF THE INVENTION

The fused high voltage electrical bushing of the present invention combines the fuse and a standard electrical bushing into a single unit without any change in the physical dimensions of the electrical bushing. The fusible element of the fuse is positioned within a passage in the bushing. The voltage stress or corona which is produced at the entrance through the casing has been eliminated by providing a layer or shield of electrically conductive material on the inner surface of the passage to increase the stress resistance of the fusible element and a layer of electrically conductive material in the form of a stress cone on the outer surface of the housing. Since the voltage stress is the greatest at the point of entrance through the casing to the electrical apparatus, both of the layers of conductive material extend outwardly from each side of the entrance through the casing for the electrical apparatus. A bushing of this type makes it possible to eliminate the fuse casing and provides a ready access for servicing the fuse.

DRAWINGS

Figure 1:
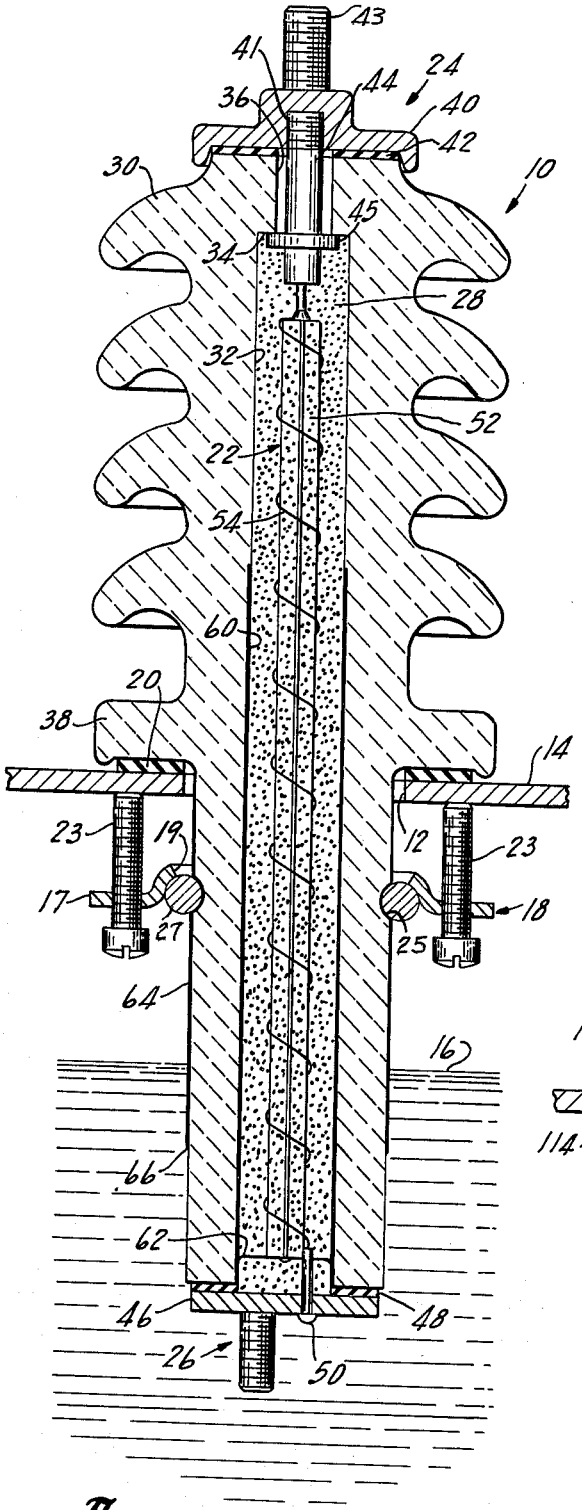
Figure 2:
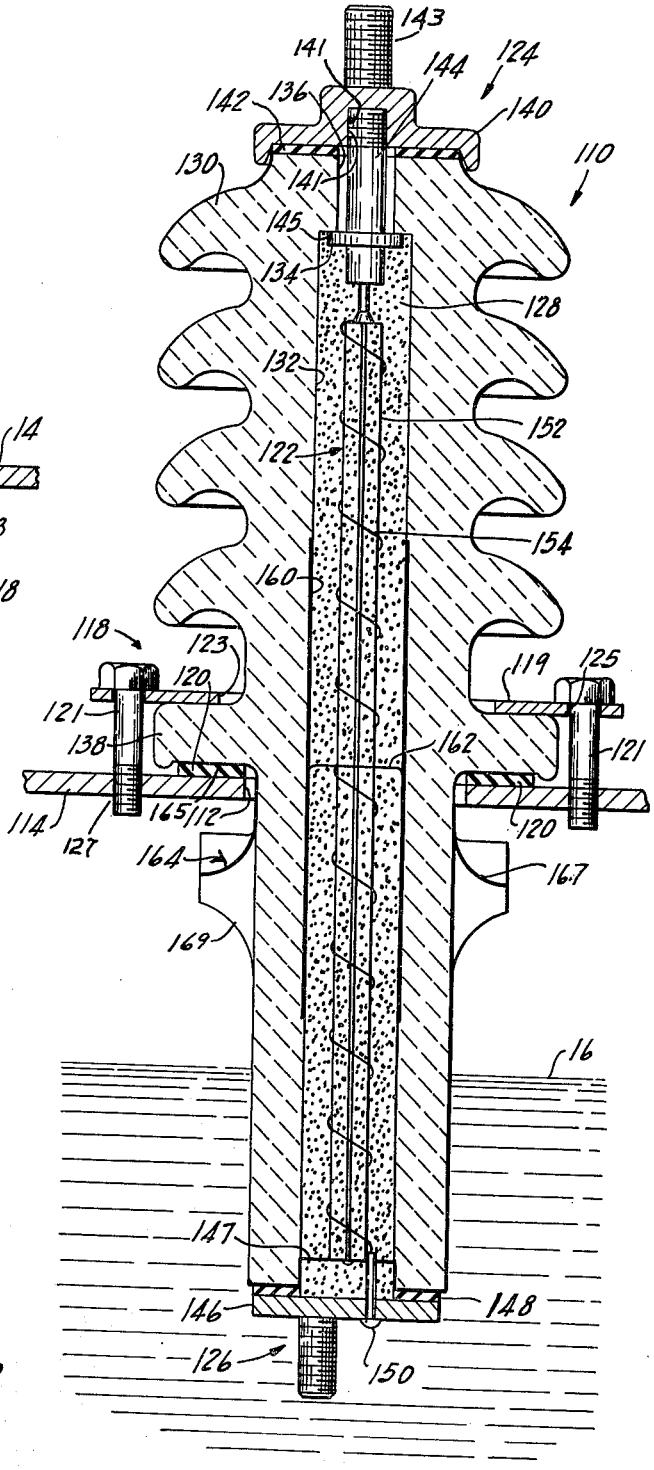

FIG. 1 is a view in section of a fused high voltage electrical bushing mounted on the casing for an oil insulated electrical apparatus; and FIG. 2 is a sectional view of a fused high voltage electrical bushing having a stress cone provided at the entrance of the bushing through the casing for the apparatus.

DESCRIPTION OF THE INVENTION

Referring to FIG. 1 of the drawings, the fused high voltage bushing 10 is shown mounted in the entrance or opening 12 through the casing 14 for an electrical device such as a transformer. The casing 14 is normally filled with a dielectric fluid or insulating oil 16 with the lower end of the bushing 10 extending into the oil 16. The bushing 10 is retained on the casing 14 by means of a mounting assembly 18 and is sealed by means of a gasket 20. A fusible element 22 is provided within the bushing 10 and is connected to electrical terminals 24 and 26 provided at each end of the bushing 10. The fusible element is embedded in a granular dielectric material 28 such as sand.

The bushing 10 includes a housing 30 having an axially extending passage 32 which terminates at one end at a shoulder 34 at the inner end of an opening 36. The housing 30 is formed of a dielectric material generally porcelain and includes a mounting flange 38.

The housing 30 is mounted on the casing 14 by means of the internal mounting assembly 18. The mounting assembly includes a mounting ring or washer

17 having a central opening 19 and a number of threaded openings 21. A threaded screw 23 is provided in each of the threaded openings 21. The mounting ring 17 is positioned on the lower end of the housing 30 and is retained thereon by means of a spring ring 27 which is seated in an annular recess 25 in the bushing. The flange 38 on the housing 30 is pulled into tight engagement with the casing 14 by merely screwing the screws 23 into abutting engagement with the casing.

The electrical terminals 24 and 26 provided at each end of the bushing 10 are used to connect the bushing to a high voltage cable on the outside of the casing 14 and to the electrical apparatus in the casing 14. The electrical terminal 24 includes a cap 40 having a threaded bore 41 and a threaded terminal 43. The cap 40 is secured to the housing 30 by means of a threaded rod 44 having a flange 45 which engages shoulder 34. The cap 40 is sealed to the housing 30 by means of a gasket 42. The terminal 26 includes a plate 46 which is connected to the fusible element 22 at the open end of the passage 32. The plate 46 is sealed to the housing 30 by means of a gasket 48. The plate 46 is electrically connected to the element 22 by means of a pin 50.

The fusible element 22 includes a spider 52 and a fusible wire 54 helically wound around the outer surface of the spider 52. The spider 52 can be formed of an insulating material such as plastic. The wire 54 is connected at one end to the rod 44 and at the other end to the pin 50. The fuse wire is normally formed of silver.

The voltage stress at the point of entrance of the fusible element 22 through the casing 14 is reduced by means of an electric shield or layer 60 of electrically semi-conductive material provided on the surface of the passage 32. The semi-conductive material can be a conductive glaze of 1 to 10 megaohms resistance or a conductive epoxy painted on the surface of the passage. The shield extends through the entrance 12 into the casing 14 and is connected to the plate 46 for the terminal 26. The wire 54 is connected to the layer 60 by means of a spring centering plate 62 provided at the end of the spider 52. The spring centering plate 62 provides an electrical connection between the fusible element and the layer 60.

Voltage stress at the entrance of the housing 30 through the opening in the casing 14 is reduced by means of an electrically conductive layer 64 provided on the outer surface of the bushing housing 30. The layer 64 extends downwardly within the casing 14 a distance sufficient for the lower end 66 of the layer 64 to be immersed in the dielectric fluid 16. The conductive material can be sprayed or painted on the bushing housing 30 and can be a conductive glaze, metallic paint or conductive epoxy. The upper end of the layer 64 is connected to ground by means of the mounting assembly 18 which is formed of an electrically conductive material.

FIG. 2

In the embodiment of the invention shown in FIG. 2, another form of fused high voltage electrical bushing 110 is shown mounted in the opening 112 through a casing 114 for an electrical apparatus. The bushing 110 is secured to the casing 114 by means of an exterior mounting assembly 118. A fusible element 122 is provided in the bushing 110 and is connected to terminals 124 and 126 provided at each end of the bushing. The terminal 124 is adapted to be connected to a high voltage cable and the terminal 126 is adapted to be connected to the electrical apparatus within the casing 114.

The bushing 110 includes a housing 130 having an axially extending passage 132 which terminates at a shoulder 134 for an opening 136 in the upper end of the housing 130. The bushing is formed of a dielectric material such as porcelain and has a flange 138 which is sealed in the entrance or opening 112 by means of an electrically conductive gasket 120.

The housing 130 is mounted on the casing 114 by means of the mounting assembly 118 which includes a split mounting ring or washer 119 and a number of screws 121. The mounting ring 119 has a central opening 123 and a number of openings 125. A number of threaded holes 127 are provided in the casing 114 corresponding to the number of holes 125 in the mounting ring 119.

The electrical terminal 124 includes a cap 140 having a threaded bore 141 and a threaded terminal 143. The cap 140 is secured to the bushing by means of a threaded rod 144. In this regard, the rod 144 includes a flange 145 which is seated on the shoulder 134. The cap 140 is tightened on the bushing by turning the cap and is sealed by means of a gasket 142. The terminal 126 includes a plate 146 which is connected to a centering plate 147 at the end of the fusible element 122. The plate 146 is sealed to the housing 130 by means of a gasket 148 and is connected to the fusible element by means of a pin 150.

The fusible element 122 includes a spider 152 and an electrically conductive fusible wire 154 helically wound around the outer periphery of the spider. The wire 154 is formed of silver and is embedded within the granular dielectric material 128. The spider 152 is connected to the rod 144 at one end and to the cap 146 at the other end.

Voltage stress on the fusible element 122 is reduced by means of an inner layer of electrically conductive material 160 provided on the surface of the passage 132. The layer 160 extends a distance above and below the entrance of the bushing through the opening 112 in the casing 114. The fusible wire 154 is connected to the layer 160 by means of a spring centering washer 162. The conductive material 160 can be the same material as used in FIG. 1.

Voltage stress on the outer surface of the housing 130 is reduced by means of a stress cone 164 formed on the outer surface of the bushing 130. In this regard, the stress cone 164 includes a conductive material 165 on the surface of the bushing and a conductive material 167 provided on an elastomeric ring 169 provided on the bushing. The stress cone 164 is electrically connected to ground through the casing 114 by means of the gasket 120. The lower end of the stress cone 164 diverges outwardly from the housing 130 to suppress voltage stress and thereby prevent the formation of corona. The material used to form the stress cone can be a conductive glaze, metallic paint or conductive epoxy.

I claim:

1. A fused high voltage electrical bushing for connecting a high voltage cable through an opening in a casing to an electrical device housed within the casing, said bushing comprising:

a housing formed of a dielectrical material and having an axially extending passage, an electric terminal sealed to each of said passage, a fusible element within said passage electrically connected to each of said terminals, a granular dielectric material completely filling said passage, a first layer of conductive material on the surface of said passage for reducing voltage stress on said fusible element, said first layer of conductive material being connected to one of said terminals and extending through the opening in said casing terminating in a spaced relation to the other of said terminals, and a second layer of conductive material on the outer surface of said housing extending through the opening in the casing, whereby said inner and outer layers of conductive material cooperate to reduce voltage stress at the point of entrance of said bushing through the opening in the casing.

2. The bushing according to claim 1 wherein said second layer of conductive material on the outer surface of said housing comprises a stress cone and including means for connecting said stress cone to ground.

3. In combination: a fuse and a high voltage electrical bushing adapted to make an electrical connection through the entrance in a casing for an electrical apparatus, said bushing being formed from a dielectric material and having an axially extending passage, a terminal sealed to each end of said passage, a fusible element within said passage connected to each of said terminals, a first layer of electrically conductive material on the surface of said passage extending through the entrance in the casing and being spaced from both of said terminals, and a second layer of electrically conductive material on the outer surface of said bushing extending through the entrance in the casing, said inner and outer layers cooperating to reduce voltage stress at the point of entrance of said bushing through said apparatus, means for electrically connecting said fusible element to said first layer of conductive material on said passage, and a granular dielectric material completely filling said passage.

* * * * *